US005875713A

United States Patent [19]

Herb

[11] Patent Number: 5,875,713

[45] Date of Patent: Mar. 2, 1999

[54] INKING SYSTEM FOR ROTARY PRINTING PRESS

[75] Inventor: Rudolf Herb, Bobenheim/Roxheim, Germany

[73] Assignee: Koenig & Bauer-Albert Aktiengesellschaft, Wurzburg, Germany

[21] Appl. No.: 928,498

[22] Filed: Sep. 12, 1997

[30] Foreign Application Priority Data

Sep. 12, 1996 [DE] Germany ..... 196 37 046.9

[51] Int. Cl.[6] ..... B41F 31/06; B41F 31/07

[52] U.S. Cl. ..... 101/150; 101/363

[58] Field of Search ..... 101/350.1, 350.2, 101/350.4, 351.1, 363, 364, 366, 207–210, 148, 150, 153, 351.3, 365; 118/259; 277/84, 92, 95, 152, 83

[56] References Cited

U.S. PATENT DOCUMENTS 4,414,900 11/1983 Kraus et al. ..... 101/363
4,419,932 12/1983 Cappel ..... 101/363
4,426,091 1/1984 Baylor ..... 277/83

FOREIGN PATENT DOCUMENTS 1 224 327 3/1967 Germany .
42 41 792 6/1994 Germany .
43 40 128 6/1995 Germany .

*Primary Examiner*—J. Reed Fisher
*Attorney, Agent, or Firm*—Jones, Tullar & Cooper, P.C.

[57] ABSTRACT

An inking system for a rotary printing press utilizes a chain seal to prevent ink from passing from the ink receiving chamber of an ink reservoir beyond the length of the portion of a cylinder to be inked. A chain seal, that is comprised of a plurality of individual plates and pins, intimately engages the surface of the cylinder and keeps the ink in the ink receiving chamber.

20 Claims, 3 Drawing Sheets

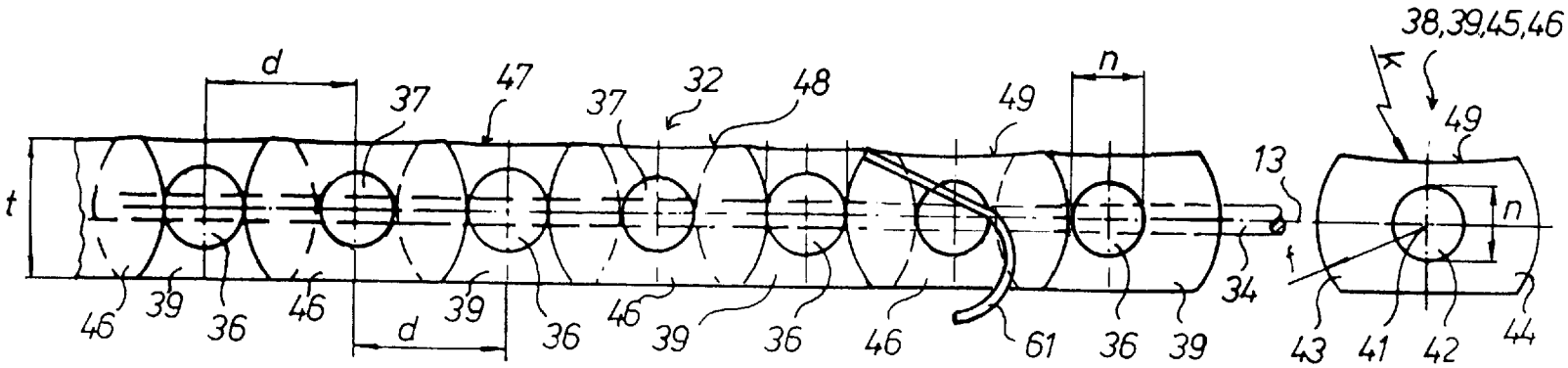
Fig.5
Fig.3
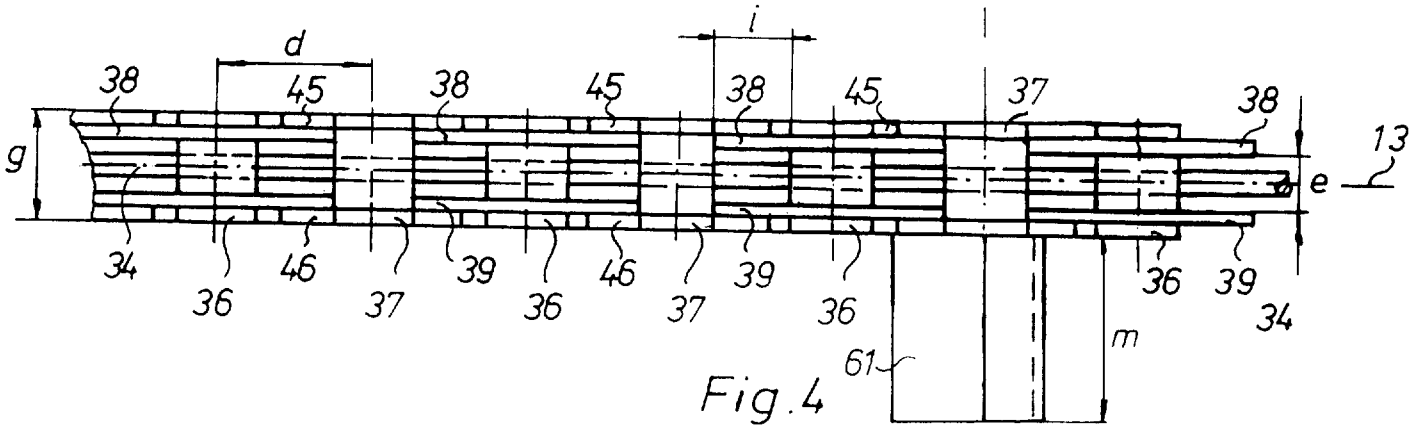
Fig.4

INKING SYSTEM FOR ROTARY PRINTING PRESS

FIELD OF THE INVENTION

The present invention is directed generally to an inking system for a rotary printing press. More particularly, the present invention is directed to a sealing arrangement for an ink reservoir for use with a rotary cylinder. Most specifically, the present invention is directed to a chain seal for an ink reservoir which cooperates with a cylinder in a rotary printing press. The ink reservoir has an overall length which is greater than the surface length of the cooperating cylinder. A pair of seal supports, with curved upper surfaces, are positioned in the ink reservoir. These seal support upper surfaces are spaced from the cylinder's peripheral surface. A chain seal is supported in each seal support with a seal surface of the chain seal being engageable with the peripheral surface of the cooperating cylinder.

DESCRIPTION OF THE PRIOR ART

It is generally known in the field of rotary printing to utilize an ink reservoir that is positioned beneath a rotating cylinder and to have a portion of the peripheral surface of the rotating cylinder come into contact with, or immerse itself in the ink that is placed in the ink reservoir. Since the ink is typically to be applied to less than the entire length of the cylinder, one prior art arrangement has utilized an ink reservoir whose overall length is less than that of the overall length of the cylinder that receives the ink. Such a structure is shown in the German patent document No. DE 43 40 128 A1 in which device the inner length of the ink reservoir is less than the overall surface length of the cylinder to be inked. The purpose of such an arrangement is to prevent ink from reaching the portions of the peripheral surface of the ink cylinder or roller which overhang or extend beyond the length of the ink reservoir.

In the German patent document No. DE 1 224 327 there is shown an integral radial seal for a gravure cylinder. This radial seal is used to define two separate inking zones.

Another cylinder inking arrangement is shown in the German patent document No. DE 42 41 792 A1. In this assembly there is shown a chamber doctor blade which cooperates with spaced side plates to define an ink receiving chamber. These two spaced side plates have sealing ribs that engage the peripheral surface of the ink cylinder or roller. These sealing ribs ride on the engraved surface of the ink cylinder or roller adjacent the ink faces of the cylinder or roller.

A limitation of these prior art devices is the possibility that ink will escape beyond the side seals of the ink reservoir and will either collect on the end faces of the associated cylinder, or will be transferred to other cylinders where it will interfere with the printing being performed. If the seals in the ends of the ink reservoir are caused to engage the face of the cylinder with a significant force, the result is either rapid seal wear or damage to the peripheral surface of the cylinder. If ink escapes from the ink receiving portion of the ink reservoir and is received on the overhanging surfaces of the cylinder, it must be able to drain back into an overflow reservoir so that it will not be deposited on other parts of the rotary printing press.

It will thus be seen that a need exists for a seal assembly that overcomes the limitations of the prior art. The inking system for a rotary printing press in accordance with the present invention provides such a device and is a significant improvement over the prior art.

SUMMARY OF THE INVENTION

It is an object of the present invention to provide an inking system for a rotary printing press.

Another object of the present invention is to provide a sealing arrangement for an inking system of a rotary printing press.

A further object of the present invention is to provide a chain seal for an ink reservoir of a rotary printing press.

Still another object of the present invention is to provide an adjustable sealing force seal arrangement.

Yet a further object of the present invention is to provide a flexible seal surface for a chain seal of an ink reservoir in a rotary printing press.

As will be discussed in detail in the description of the preferred embodiments which is presented subsequently, the inking system for a rotary printing press in accordance with the present invention utilizes an ink reservoir that has a total length which is greater than the portion of the length of the cylinder whose peripheral surface is provided with ink from the ink reservoir. A pair of seal supports are situated in the ink reservoir and cooperate with the sides and bottom of the reservoir to define an ink retaining chamber. These seal supports are located inboard of the end walls of the ink reservoir so that the length of the ink retaining chamber is less than the overall length of the peripheral surface of the ink roller or cylinder that cooperates with the ink reservoir. An upper face of each seal support is curved or arcuately shaped and has a radius that corresponds generally to the radius of the cylinder. This upper face of the seal support is spaced from the cylinder peripheral and a chain seal is situated in the gap that is formed by this spacing distance. The chain seal is comprised of a plurality of pins and side plates which have upper surfaces that engage the cylinder periphery. An adjustable tensioning force can be applied to the chain seal to insure a proper contact force between the seal and the surface of the cylinder.

The inking system of the present invention has several advantages. One of these of course is that the chain seal forms an effective seal between the ink receiving chamber of the ink reservoir and the peripheral surface of the cylinder that receives ink from the ink reservoir. The sealing force can be adjusted by changing the tension which is applied to the chain seal. If the peripheral surface of the cylinder is not uniform, or if the size of the cylinder changes slightly due to, for example, wear or even as a result of cylinder substitution, the chain seal will accommodate to the cylinder shape and will maintain its excellence sealing characteristics without resorting to the high seal forces which in various prior art devices have led to either seal or to cylinder wear.

The ink reservoir has an overall length that is greater than the length of the cylinder peripheral surface. However, the spacing between the two seal supports is less than the overall length of the cylinder. This allows outboard portions of the cylinder, which do not contact ink in the ink receiving chamber, to overhang the portions of the ink reservoir that are exterior to the ink receiving chamber. Any ink that may pass by the chain seals will be able to fall into these outboard portions of the ink reservoir which thus effectively act as excess ink receptacles.

The inking system for a rotary printing press in accordance with the present invention overcomes the limitations of the prior art. It is a substantial advance in the art.

BRIEF DESCRIPTION OF THE DRAWINGS

While the novel features of the inking system for a rotary printing press in accordance with the present invention are set forth with particularity in the appended claims, a full and complete understanding of the invention may be had by referring to the detailed description of the preferred embodiments, which is presented subsequently, and as illustrated in the accompanying drawings, in which:

FIG. 3 is a side elevation view of a first preferred embodiment of a chain seal in accordance with the present invention;

FIG. 4 is a top plan view of the seal chain of FIG. 3;

FIG. 5 is a side elevation view of a chain side plate for use in the chain seal shown in FIGS. 3 and 4;

DETAILED DESCRIPTION OF THE PREFERRED EMBODIMENTS

Figure 2:
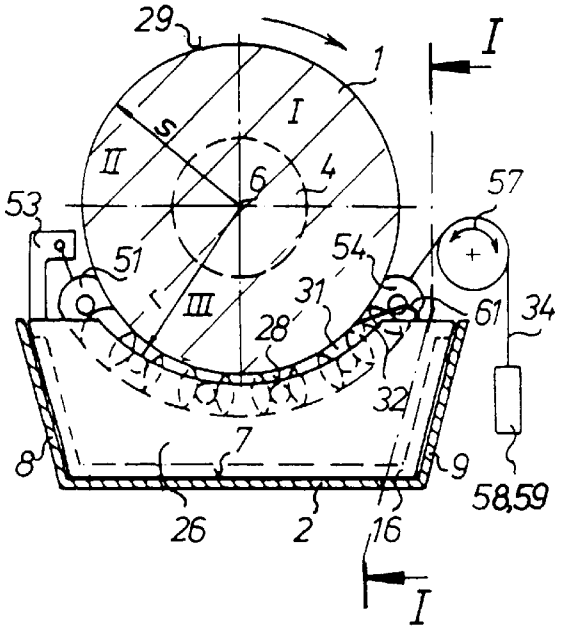
FIG. 2 is a cross-sectional view of the inking system and taken along line II—II of FIG. 1.
Figure 1:
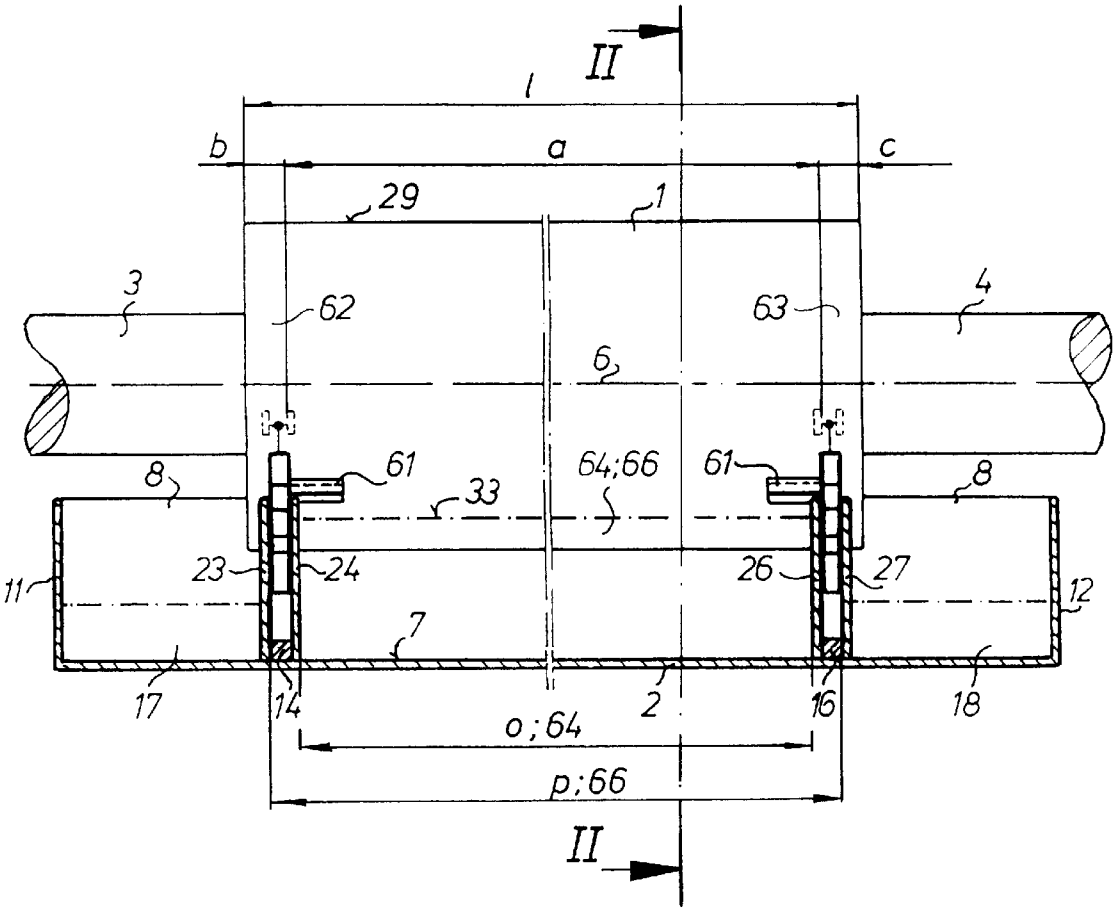
FIG. 1 is a side elevation view of a simplified schematic depiction of an inking system for a rotary printing press, partly in section, in accordance with the present invention and taken along line I—I of FIG. 2.

Referring initially to FIG. 1, taken in conjunction with FIG. 2, there may be seen an inking system for a rotary printing press in accordance with the present invention. In this depicted inking system, an ink reservoir, generally at 2 is supported beneath a cylinder 1 to which ink is to be applied. The ink reservoir 2 can be adjusted vertically by a generally conventional hydraulic or other similar system. The cylinder 1 to which the ink from the ink reservoir 2 will be applied may be a forme cylinder that is part of a gravure type rotary web-fed printing press or it may be an engraved or screen surface roller of a short inking system. The specific type of printing press is not part of the subject invention and hence will not be discussed in detail.

The forme or other cylinder 1 is structured having a generally cylindrical body whose peripheral surface carries the printing formes or plates that are to be inked with the ink supplied by the ink reservoir 2 or which is provided with the engraved or screen surface. The cylinder body is supported for rotation by journals 3 and 4 which would be positioned in suitable bearings in press side frames that are not specifically depicted. The cylinder body is thus rotatable about a longitudinal axis of rotation 6. It will be understood that cylinder 1 would typically cooperate with an impression cylinder, which is also not shown, to print a web of paper which passes between the forme cylinder 1 and the cooperating impression cylinder or may transfer ink from the ink reservoir 2 to another cylinder.

The ink reservoir 2 is provided, on its inner surface, with a pair of spaced ink seal support retainers 14 and 16. Each of these retainers, as seen in FIGS. 1 and 2, is a generally square or rectangular in cross-section length of steel pipe or tubing that extends transversely across the floor 7 of the ink reservoir 2 and up the reservoir's two side walls 7 and 8. These ink seal support retainers 14 and 16 are situated in the ink reservoir 2 at a distance inboard of end walls 11 and 12 of the reservoir 2. The first or left retainer 14 is situated inboard of the first or left end wall 11 while the second or right retainer 16 is situated inboard of the second or right end wall 12, all as may be seen in FIG. 1.

Each of the left and right ink seal support retainers 14 and 16 as its name suggests, retains an ink seal support. Again referring to FIG. 1, each of these ink seal supports is structured having an outer seal support wall 23 or 26, and an inner seal support wall 24 or 27. Thus the left seal support is denoted as 23, 24 while the right seal support is denoted as 26, 27. These ink seal supports 23, 24 and 26, 27 are securable to their respective retainers 14 and 16 in a snap-fit or plug-in manner. The outer and inner seal support walls 23, 24 and 26, 27 are shaped to cooperate with the inner configuration of the ink reservoir and of the retainers 14 and 16. Each of these seal support walls 23, 24; 26, 27 may be made of brass plate or plastic or another similar material, and are spaced rigidly slightly apart from each other by a suitable spacer or arrangement of spacers which are not specifically depicted in FIG. 1. It will be understood that while the seal supports 23, 24 and 26, 27 are intended to snap-fit onto their retainers 14 and 16 in a geometrically locking manner that it would also be possible to positively secure these seal supports to their retainers such as by the use of bolts, screws, spot welds or the like.

Each of the seal support walls 23, 24, 26 and 27 has an upper surface 28 which faces or is adjacent to the circumference or peripheral surface 29 of the cylinder 1 to which ink will be applied from the ink reservoir 2. As may be seen in FIG. 2, each such ink seal support wall's upper face 28 is curved or arcuate in shape and has a radius of curvature "r" which, as seen in FIG. 2 is greater than the radius "s" of the cylinder 1. This results in the formation of a gap or space 31 that is subtended between the circumference 29 of the cylinder 1 and the upper face 28 of each of the ink seal support walls.

An elongated flexible seal, generally at 32, which is able to intimately engage or hug the peripheral surface 29 of the cylinder 1, is positioned in each gap 31 and is supported by the spaced seal supports 23, 24 and 26, 27. Each such elongated, flexible seal 32 effectively closes the gap 31 between the cylinder periphery 29 and the upper face 28 of each of the seal support walls 23, 24; and 26, 27. In the arrangement depicted in FIGS. 1 and 2 in which each seal support is comprised of spaced outer and inner seal support walls 23 and 24 or 26 and 27, the width of the elongated, flexible seal 32 is selected so that each side of the elongated, flexible seal 32 is positioned about 0.1 mm from an interior surface of each of the support walls 23 and 24 or 26 and 27.

As was indicated previously, the left and right seal supports 23, 24 and 26, 27 are attached to the interior bottom and side wall surfaces 7, 8 and 9, respectively of the ink reservoir 2, through their cooperation with their associated retainers 14 and 16 inboard of the end walls 11 and 12 of the ink retainer. An interior spacing distance "a" between the interior or inner faces of the two seal elements 32 is less than the surface length "l" of the cylinder 1. This results in the provision of an annular overhang or ink-free zone 62 or 63 at the ends of the cylinder 1. These ink free zones 62 and 63 have lengths "b" and "c" respectively with, in the preferred embodiment both of these overhang lengths being generally 50 mm.

An ink receiving chamber 64 of a length "o" is defined by the inner side walls 24 and 26 of the ink seal supports and the ink reservoir bottom 7 and sides 8 and 9. This ink receiving chamber 64 will be filled to level 33 with a suitable ink and the lowest portion of the cylinder 1 will have its peripheral surface 29 immersed in this ink. It will be understood that typically an inking roller will act against the peripheral surface 29 of cylinder 1. This inking roller will be mounted within the periphery of the ink reservoir 2 and between the left and right ink seal support sidewalls 23, 24 and 26, 27. A suitable doctor blade, which is also not depicted in the drawings, will cooperate with the surface of the cylinder 1 to scrape excess ink off the surface 29 of the cylinder 1 before the paper web is inked. This doctor blade can rest against the peripheral surface 29 of the forme cylinder 1 in the areas of quadrants I, II or III as these are shown in the cross-sectional view of cylinder 1 shown in FIG. 2. An ink overflow chamber 17 or 18 is formed at the left and right ends of the ink reservoir 2 outboard of the ink seal supports 23, 24; 26, 27. Each such ink overflow chamber 17 or 18 is defined by its respective outer ink seal support wall 23 or 27 and the bottom 7 and side walls 8 and 9 of the ink reservoir. Any ink that may pass from the ink receiving chamber 64, past the ink chamber seals 32 and that may move along the peripheral surface 29 of the forme cylinder 1 to the overhanging outboard annular cylinder portion 62 and 63 will be received in the respective left and right ink overflow chamber 17 and 18. It will be understood that the ink reservoir 2 will be provided with an ink feed line that continually replenishes the ink in the ink receiving chamber 64 and maintains it at the ink level 33 indicated with dashed lines in FIG. 1. It will also be understood that each of the ink overflow chambers 17 and 18 will be provided with a drain line so that any collected overflow ink can be returned to an ink supply source.

Turning now to FIGS. 3–5, there may be seen a first preferred embodiment of an ink chain seal, generally at 32 in accordance with the present invention and which is positionable in the gap or space 31 between the periphery 29 of the forme cylinder 1 and the upper, arcuate faces 28 of the four ink seal support walls 23, 24; 26, 27. This seal 32 is generally in the form of a bicycle or roller type chain that includes transverse bolts 36 and 37, and a plurality of side links or plates 38, 39, 45 and 46. In the subject invention the chain seal 32 is made of a suitable wear resistant, ink solvent resistant material, such as any of a number of suitable plastics such as Delrin. A solvent-resistant traction means, such as a cable 34 which is made of plastic or nylon, extends along the length of the chain seal 32. All of the spaced chain bolts or pins 36 and 37 have a generally cylindrical shape and are generally round in cross-section. Each bolt or pin 36 and 37 has a central transverse bore through which the traction cable 34 passes. Each bolt or pin 36 and 37 is secured to traction cable 34 by suitable means and is spaced from each other along the cable 34 at a spacing distance "d" of preferably 20 mm. The axis of rotation 35 of each of the bolts 36 and 37 runs generally perpendicular to the longitudinal axis 13 of the cable 34.

A plurality of identical side links 38, 39, 45 and 46 cooperate with the bolts or pins 36 and 37 to form the chain seal 32. One such side link is depicted in FIG. 5 and may be seen as being generally rectangular with a central aperture 42 of a diameter "n". This central aperture 42 is sized so that each link 38, 39, 45 or 46 will snugly slip over an end of one of the bolts or pins 36 or 37. Each of the longitudinally spaced ends 43 and 44 of each side link 38, 39, 45 or 46 is arcuate in shape and has a radius "f" as measured from the center 41 of the central aperture 42. This radius "f" corresponds to the spacing distance "d" between adjacent pins or bolts 36 and 37 on cable 34 less the radius of one of these pins or bolts 36 or 37. Thus, as seen most clearly in FIG. 3, when each side link or plate 38, 39, 34 or 46 is placed on its respective chain bolt or pin 36 or 37, the longitudinal ends 43 and 44 of that chain link or plate will rest against the outer circumferential surface of the two longitudinally adjacent pins or bolts 36 or 37.

As is depicted more clearly in FIG. 4, each bolt 36 supports or receives two inner chain links or plates 38 and 39 whereas each chain bolt or pin 37 supports or receives two outer chain links or plates 45 and 46. All of the bolts 36 and 37 have the same diameter "n" and each of the chain links or plates 38, 39, 45 and 46 is identical in shape. The bolts 36 and 37 each have a length "h" of, for example 15 mm. The outer surfaces of the two outer links or plates 45 and 46 that are carried by each bolt 37 are spaced apart at a distance "g" of, for example 13 mm while the inner surfaces of the inner links or plates 38 and 39 that are carried by each bolt 36 are spaced apart at a distance "e" that is less than "g". Thus "e" is less than "g" by four times the thickness of each chain plate or link 38, 39, 45 or 46.

As was set forth above, the arcuate ends 43 and 44 of the outer chain plates 45 and 46 extend as far as the circumferential surfaces of the adjacent bolts 36 while the arcuate ends 43 and 44 of the inner chain plates or links 38 and 39 extend as far as the circumferential surfaces of the bolts 37. As a result, the ends of the outside plates or links 45 and 46 overlap the ends of the inner plates or links 38 and 39 by overlay distance "i" which is the spacing distance between the adjacent peripheral surfaces of each two adjacent bolts or pins 36 and 37. Accordingly, two inside chain plates or links 38 and 39, slipped onto a bolt 36 form jointly with the cable 34 an inside seal member 47. Two outside chain plates or links 45 and 46, slipped onto a bolt 37, form jointly with the cable 34 an outside seal member 48. The chain seal 32 is thus formed by a series of inside seal members 47 and outside seal members 48 which are situated in a serial fashion along the length of the cable 34. Because of the intimately overlapping seal members 47 and 48, the elongated chain seal 32 is provided with excellent sealing capabilities as well as good two dimensional displaceability. The chain seal 32 further evidences a great ability to intimately engage or "hug" the peripheral surface 29 of the forme cylinder 1. As may be seen in FIG. 5, the upper surfaces 49 of each of the chain links or plates 38, 39, 45 and 46 has an arcuate concave surface with a radius "k". This radius "k" is preferably between 7 and 11 times the distance of the spacing "d" between the center of adjacent bolts or pins 36 and 37. This concave upper surface 49 of each link or plate 38, 39, 45 and 46 improves the ability of the chain seal 32 to intimately engage the peripheral surface 29 of the cylinder. It would also be possible to provide the chain plates or links 38, 39, 45 and 46 with straight or planar upper surfaces 49. If the relative number of such links or plates 38, 39, 45 and 46 in the chain seal 32 is relatively large, as would be required in the situation of a large diameter forme cylinder 1, the chain seal 32 will still provide a good sealing engagement with the peripheral surface 29 of the forme cylinder 1. As was stated previously, each of the chain plates or links 38, 39, 45 and 46 which cooperate to make up the overlapping seal members 47 and 48 are made of materials which are resistant to the solvents, such as toluene which are present in gravure inks. These materials may be rubber-elastic or elastomeric materials such as nylon or Delrin. Each of the seal members 47 and 48 has a height "t" that corresponds approximately to the center spacing distance "d" between the adjacent bolts 36 and 37.

Turning back to FIG. 2, it will be seen that the chain seal 32 is situated in the gap between the upper faces 28 of the seal support walls 23, 24; 26, 27 and the peripheral surface 29 of the cylinder 1. A first, anchored end 51 of the seal 32 is secured in place in the gap 31 by attachment of the cable 34 to a suitable support 52 or 53 that is affixed to the side wall 8 of the ink reservoir 2. Only the support 53 is shown in FIG. 2. A second or tensioned end 54 of chain seal 32 is positioned by passing the cable 34 over a roller 56 or 57, with only roller 57 being depicted in FIG. 2. This tensioned end of cable 34 is then connected to a suitable tensioning spring (not shown) or may have a counterweight 58 or 59 attached to it. The result is that the chain seal 32 is supported under tension in the gap 28 and is free to move between the spaced walls 23 and 24 or 26 and 27 of its associated seal support. The tendency therefore of the chain seal 32 would be to assume a straight line. However, as the ink reservoir 2 is elevated into place beneath the forme cylinder 1, the peripheral surface 29 of the cylinder 1 will contact the upper surfaces 49 of the chain links or plates 38, 39, 45 and 46 and will cause the chain seal 32 to assume the same curvature as the peripheral surface 29 of the forme cylinder 1 thereby providing an intimate seal between the two.

The inking system for a rotary printing pres in accordance with the present invention operates in the following manner. When the ink reservoir 2 is raised into its operative position beneath the cylinder 1, the chain seals 32, which are positioned between the inner and outer walls of the seal supports 23, 24 and 26, 27 will engage the peripheral surface 29 of cylinder 1. Any gravure ink that may have spilled through the gap 31 will be caught in the overflow chambers 17 and 18 of the ink reservoir 2. The outer sidewalls 23 and 27 of the seal supports may be provided with drain holes adjacent the retainers 19 and 16 so that any ink that finds its way from the ink receiving chamber 64 into the spaces between the inner and outer seal support walls 23 and 24, or 26 and 27 can drain out into the overflow chambers 17 or 18. As discussed above, each counterweight 58 or 59 insures that its associated chain seal 32 will intimately engage the surface 29 of cylinder 1.

It is possible to attach a short doctor blade 61 to one of the outer seal members 48 by securement of the doctor blade 61 to the chain link or plate 45 or 46. As may be seen most clearly in FIG. 1, each such short doctor blade 61 will be oriented pointing toward the center of the cylinder 1. This will allow each doctor blade 61 to remove excess ink from the cylinder 1 in the vicinity of the seal assemblies 32. These short doctor blades will thus be located within the length "a" of the cylinder 1 inside the inner sidewalls 24 and 26 of the seal supports. The length of the doctor blade 61 is shown in FIG. 4 as being a length "m" with this doctor blade length corresponding generally to the spacing distance "d" between bolts or pins 36 and 37 in the chain seal 32.

Referring again to FIG. 5, as was discussed previously the upper edge 49 of each chain link or plate 44 is provided with a concave shape. The lower edge of each link or plate is shown as being planar. It would also be possible to make this surface curved and having a radius of curvature "f". The chain seal 32 may be kept lubricated by allowing a slight amount of the ink from the ink receiving chamber 64 to pass across the seal 32. This will prevent the seal 32 from running dry. Alternatively, the overhang regions 62 and 63 of the cylinder 1 may be sprayed with a solvent for the printing ink. A suitable solvent is toluene.

Figure 6:
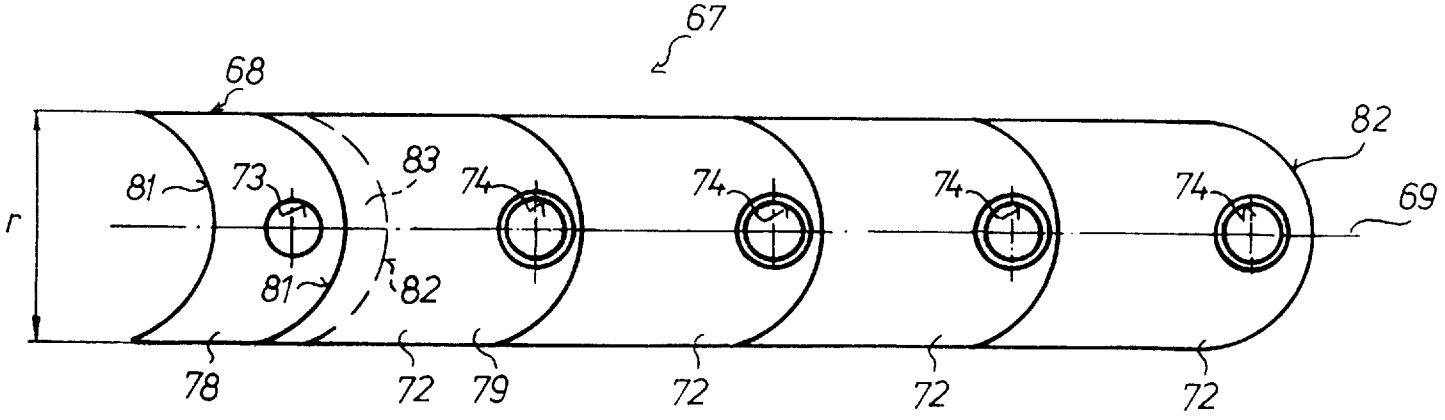
FIG. 6 is a side elevation view of a second preferred embodiment of a chain seal.
Figure 7:
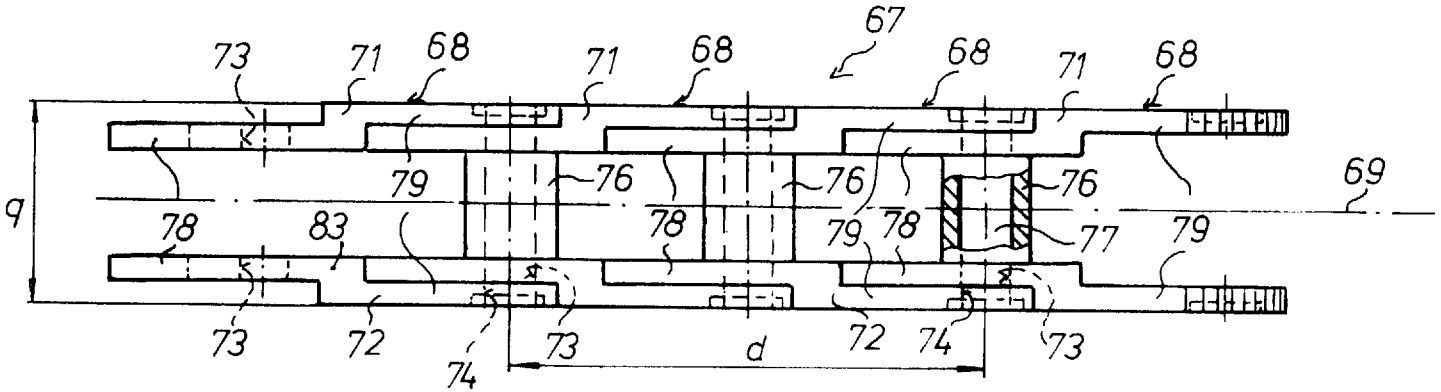
FIG. 7 is a top plan view of the chain seal of FIG. 6.

Referring now to FIGS. 6 and 7 there may be seen, generally at 67, a second preferred embodiment of a chain seal for an inking system of a rotary printing press in accordance with the present invention. This chain seal 67 is similar to a roller chain, as was the first seal assembly 32 and consists of a number of sequentially positioned seal members 68. Each such seal member 68 is formed by a pair of chain links or plates 71 and 72 which are identical and which are mounted symmetrically to a longitudinal axis 69 of the chain seal 67. Each such chain link or plate 71 or 72 has two plate webs, an inner web 78 and an outer web 79. These webs 78 and 79 are joined by a step so that each plate or link 71 or 72 is somewhat Z shaped, as seen in top plan view in FIG. 7. Each of these inner and outer webs 78 and 79 has a concave trailing edge 81 or 83 and a convex leading edge 82. As seen in FIGS. 6 and 7, the chain seal 67 is assembled with an outer web 79 of each chain link or plate 71 or 72 overlapping an inner web 78 of the adjacent chain link or plate 71 or 72. The cooperating convex and concave surfaces 81, 82 and 83 allow the chain seal 67 to bend or deflect in a direction perpendicular to its longitudinal axis 69. Each set of links or plates 71 and 72 is connected to its longitudinally adjacent cooperating set of links or plates 71 and 72 by a bolt or pin 77 that passes through suitable bores 73 and 74 in the inner and outer webs. These chain links or plates 71 and 72 in each sealing member 68 are separated by spacers 76 that are placed about the bolts or pins 77. As seen in FIGS. 6 and 7, this chain seal 67 has a width "q" and a height "r". This chain seal 67 is used in the same manner as was discussed in connection with the first preferred embodiment 32.

It would also be possible to provide a chain seal whose surface facing the periphery 29 of cylinder 1 could have a surface contour similar to an oblique tooth arrangement of a spur gear. The seal chain could also be structured in the manner of a socalled Gall's chain.

In the depicted seal arrangements, the seal supports each have two spaced seal support sidewalls 23 and 24 or 26 and 27. It would be possible to omit the outer sidewalls 23 and 27 while maintaining the length "o" of the ink receiving chamber 64. In an alternative configuration, the inner sidewalls 24 and 26 could be omitted to provide an ink receiving chamber 64 of a longer length. In these two alternate embodiments, the seal chain still seals the gap 31. It may be necessary to utilize appropriate guides to replace the missing sidewalls of the seal supports.

While preferred embodiments of an inking system for a rotary printing press in accordance with the present invention have been set forth fully and completely hereinabove, it will be apparent to one of skill in the art that a number of changes in, for example, the overall size of the cylinder, the specific type of ink used, the drive for the cylinder and the like may be made without departing from the true spirit and scope of the present invention which is accordingly to be limited only by the following claims.

What is claimed is:

1. An inking system for a rotary printing press comprising:

a cylinder having a cylinder length and a peripheral surface;

an ink reservoir positioned beneath said cylinder and having an ink receiving chamber, said ink receiving chamber having a chamber length less than said cylinder length;

first and second seal supports in said ink reservoir and defining ends of said ink receiving chamber, each of said seal supports having an upper recess oriented toward said cylinder peripheral surface and separated from said cylinder peripheral surface by a gap; and a seal supported in said recess and filling said gap, said seal having a plurality of individual elements connected to each other.

2. The inking system of claim 1 wherein each of said seal supports includes inner and outer spaced seal support sidewalls.

3. The inking system of claim 2 wherein said recess in each of said seal supports is defined by said inner and outer spaced seal support sidewalls.

4. The inking system of claim 3 wherein said seal is supported in said recess out of contact with said sidewalls.

5. The inking system of claim 1 wherein said seal supports are removable from said ink reservoir.

6. The inking system of claim 1 wherein said seal is a chain seal having a plurality of links.

7. The inking system of claim 6 wherein said plurality of links include inner and outer links and further including a plurality of bolts supporting said inner and outer links, and a cable, said bolts being strung on said cable.

8. The inking system of claim 6 wherein each of said links has first and second end faces, each of said end faces having a convexly curved shape.

9. The inking system of claim 6 wherein said plurality of links are geometrically interlocking and intimately engaged in rows.

10. The inking system of claim 6 wherein each of said links has first and second spaced bores and further including bolts passing through said bores and connecting said plurality of links.

11. The inking system of claim 1 further including a plurality of said seals supported in each said recess.

12. The inking system of claim 6 wherein said chain seal is shaped as a Gall's chain.

13. The inking system of claim 1 further including a short doctor blade attached to said seal and engaging said peripheral surface of said cylinder.

14. The inking system of claim 6 wherein each of said links has an upper surface engageable with said peripheral surface of said cylinder.

15. The inking system of claim 14 wherein said upper surface of each of said links is curved.

16. The inking system of claim 14 wherein said upper surface of each of said links is straight.

17. The inking system of claim 1 wherein said seal is plastic.

18. The inking system of claim 1 further including means to force said seal against said peripheral surface of said cylinder.

19. The inking system of claim 1 wherein said cylinder is a gravure cylinder.

20. The inking system of claim 1 wherein said cylinder is an engraved roller of an offset inking system.

* * * * *